US009446531B2

(12) United States Patent
Mathues et al.

(10) Patent No.: US 9,446,531 B2
(45) Date of Patent: Sep. 20, 2016

(54) CONSTANT ACCELERATION HYDROCUTTING SYSTEM

(71) Applicant: Vanmark Equipment, LLC, Creston, IA (US)

(72) Inventors: Thomas P. Mathues, Creston, IA (US); Colter J. Young, Boise, ID (US)

(73) Assignee: VANMARK EQUIPMENT LLC, Creston, IA (US)

( * ) Notice: Subject to any disclaimer, the term of this patent is extended or adjusted under 35 U.S.C. 154(b) by 121 days.

(21) Appl. No.: 14/216,104

(22) Filed: Mar. 17, 2014

(65) Prior Publication Data

US 2014/0260862 A1 Sep. 18, 2014

Related U.S. Application Data

(60) Provisional application No. 61/789,355, filed on Mar. 15, 2013, provisional application No. 61/878,111, filed on Sep. 16, 2013.

(51) Int. Cl.

| | |
|---|---|
| ***B26D 1/03*** | (2006.01) |
| ***B26D 7/06*** | (2006.01) |
| *B26D 3/26* | (2006.01) |

(52) U.S. Cl.

CPC ..... *B26D 7/0658* (2013.01); *B26D 3/26* (2013.01); *Y10T 83/6472* (2015.04)

(58) Field of Classification Search

CPC ..... Y10T 83/6472; Y10T 83/2066; B26D 7/0658; B26D 3/26

USPC ..... 83/402, 98, 932; 99/516

See application file for complete search history.

(56) References Cited

U.S. PATENT DOCUMENTS

| | | | | |
|---|---|---|---|---|
| 4,372,184 | A * | 2/1983 | Fisher | B26D 3/185 83/102 |
| 4,423,652 | A * | 1/1984 | Winslow | B26D 7/01 83/107 |
| 4,603,810 | A | 8/1986 | Schleimer et al. | |
| 4,614,141 | A | 9/1986 | Mendenhall et al. | |
| 4,656,909 | A | 4/1987 | Carter et al. | |
| 4,807,503 | A * | 2/1989 | Mendenhall | B26D 3/185 83/112 |
| 4,911,045 | A * | 3/1990 | Mendenhall | B26D 1/0006 83/24 |
| 5,046,388 | A * | 9/1991 | Mendenhall | B26D 1/0006 83/24 |
| 5,168,784 | A * | 12/1992 | Foster | B26D 3/11 83/24 |
| 5,191,823 | A * | 3/1993 | Miller | B26D 7/00 83/402 |
| 5,390,590 | A * | 2/1995 | Mendenhall | A23N 4/22 83/402 |
| 5,421,226 | A | 6/1995 | Mendenhall | |
| 5,568,755 | A | 10/1996 | Mendenhall | |
| 5,806,397 | A | 9/1998 | Mendenhall | |
| 2004/0040427 | A1 * | 3/2004 | Mendenhall | A23L 1/217 83/98 |

FOREIGN PATENT DOCUMENTS

| | | | | |
|---|---|---|---|---|
| NL | 1007265 | C2 * | 4/1999 | B26D 7/0658 |

* cited by examiner

*Primary Examiner* — Omar Flores Sanchez

(74) *Attorney, Agent, or Firm* — Jason H. Foster; Kremblas & Foster

(57) ABSTRACT

An improvement to hydrocutting systems includes a curved shape for the acceleration and deceleration sections of the system. In the acceleration and deceleration tubes, the curvature of the sidewall is non-linear along its length, and the water flowing therein accelerates, positively or negatively, at a substantially constant rate. In an embodiment, there is a second curvature, which may be offset from the first curvature by about 90 degrees, that accelerates the water at a second, different substantially constant rate, in order to align the food product both lengthwise and rotationally to a desired orientation.

12 Claims, 5 Drawing Sheets

CONSTANT ACCELERATION HYDROCUTTING SYSTEM

CROSS-REFERENCES TO RELATED APPLICATIONS

This application claims the benefit of U.S. Provisional Application No. 61/789,355 filed Mar. 15, 2013, and U.S. Provisional Application No. 61/878,111 filed Sep. 16, 2013. This prior application is hereby incorporated by reference.

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

The invention relates generally to hydrocutting of food, and more particularly to a method and apparatus for maintaining constant acceleration of food products in a hydrocutting system.

Many food products, particularly vegetables and fruits, are processed prior to sale to preserve the food so it is safe and appealing at the time of consumption. The processing can be by canning or freezing, among others. Furthermore, unless it is an edible size before processing, most food products must be sliced or otherwise shaped into an edible size prior to the preservation process. Slicing and shaping operations have been accomplished traditionally with sharpened blades. Such blades can be hand-held, but hand-held knives are relatively slow and dangerous to the person using them. Other blades are machine-driven and other machines for cutting drive the food products at high speed into a stationary or machine-driven blade. Food cutting machines increase the rate and consistency of slicing, and provide a higher degree of safety in the food slicing industry.

Recent advances in food product cutting technologies have resulted in the hydraulically fed cutting apparatus. The driving force used in this system is moving water, and thus the process is called "hydraulic cutting", which is referred to by the shorthand term "hydro-cutting". Hydrocutting involves the propulsion of water and food products, typically at very high speed, through a path that includes a stationary cutting blade. In the vegetable and fruit cutting industry, food products are sliced along the longitudinal axis (e.g., French fries) and along the transverse axis (e.g., potato chips). Production cutting systems and related knife fixtures are generally well known in the art of hydrocutting vegetable products. Typical hydrocutting systems have a knife fixture that is mounted at a position along the path of the food product to slice parallel to the flow of water. Such parallel cutters usually cut or slice into strips or, with added motions, into a helical shape. In such a system, the food products are conveyed one-at-a-time in single file succession into the stationary cutting blades with enough kinetic energy to carry the product through the stationary knife fixture.

Hydraulic food cutters are used to cut a wide variety of food products, including potatoes, carrots, beets, zucchini, cucumbers, and others. Cutting potatoes has been the most common application of hydrocutting machines. However, it should be understood that these hydraulic food cutters are capable of cutting, and are used to cut, a wide variety of food products.

The basic configuration of a prior art hydrocutting system is shown, in schematic format, in FIG. 1. In such a typical prior art hydraulic cutting apparatus, where potatoes are to be cut, the potatoes are dropped into a tank 10 filled with water and then pumped through conduit into an alignment chute or tube 12 wherein the potatoes are aligned and accelerated to high speed before impinging upon a fixed array of cutter blades where the potato is cut into a plurality of smaller pieces.

The tank filled with water, which is one of the components of a prior art hydraulic cutting apparatus for use in cutting potatoes, is referred to as a receiving tank 10. Peeled or unpeeled potatoes are dropped into the receiving tank and a food pump 13, typically a single impeller centrifugal pump, is provided to drive the potatoes through the system. The pump draws water from the receiving tank and pumps the water and the suspended potatoes from the tank into the accelerator tube 12, which functions as the converging portion of a venturi. The accelerator tube is used to accelerate, singulate, and align the potatoes immediately prior to impinging upon the stationary knife blades of the cutter blade assembly 14.

The use of an accelerator tube is required in order to perform at least three functions. First, the accelerator tube accelerates the water and food product to the velocity required in order for it to pass cleanly through the knife blade assembly. Second, the accelerator tube aligns and centers the food products prior to impingement upon the knife blade assembly. In the case of potatoes, a common velocity range is from about 40 to about 60 feet per second. Third, the acceleration of the product causes multiple products to separate while aligning them, thereby causing them to enter the cutter in a single file line.

Potatoes can be cut into French fry sticks as one example of the use of hydrocutting systems, and will be used as an example hereafter. A person of ordinary skill will understand, after reading the description herein, how to adapt the apparatus described herein to other food products. Each whole potato impinging upon the knife blade assembly at high speed passes through the cutting blade array and is thereby cut into a plurality of food pieces, for example French fry pieces. The cross section of each of the food strips is determined by the arrangement of the cutter head knives.

A portion of the hydrocutting system separates the food product strips from the water once the strips are past the cutter head. It is desirable to slow down the water column and the food product strips within it in a controlled manner before this separation portion is encountered. This is because the strips may be fragile (depending on the food product) and gentle handling in the sections following cutting prevents breakage of, or stress on, the strips that would render the strips less desirable. The food strip pieces thus pass with the water into the second half of the venturi which is a diverging tube 15 in which the water and the cut food pieces are decelerated back to a slower velocity. The water and cut food pieces are then deposited onto a dewatering conveyer 16. The water passes through the dewatering conveyor and is collected and recycled back to the receiving tank. The cut food pieces remain on the conveyor and are carried off for further processing.

During the cutting process, as the potato approaches the cutting knives, the potato needs to be aligned and stabilized with the central axis of the knife set. This alignment maximizes finished product yield. In the past, significant effort has been directed toward the development of good alignment or acceleration tubes that can properly align and accelerate the whole food product so that each whole food product is properly centered relative to the cutter blade array prior to impinging upon it. An example of these efforts can be seen in U.S. Pat. No. 4,614,141, which teaches an alignment tube assembly used to accelerate and align whole potatoes immediately prior to impinging upon a cutter head array. Other patents of interest include U.S. Pat. No. 5,568,755 and U.S. Pat. No. 5,806,397, both of which, along with U.S. Pat. No. 4,614,141, are hereby incorporated by reference.

As noted above, the water and the food product are pumped through a decreasing diameter accelerating section conduit in order to increase the speed of the food products and water as they approach the blade. Unless otherwise specified, the term "acceleration" and its derivatives are used herein to denote both positive and negative (increasing and decreasing) changes of velocity per unit time. While the water and food products increase in speed through the accelerating section, the individual items in the stream made up of water and multiple food products also orient and align for cutting as they pass through the cutter head. The accelerating section also singulates the food products, meaning the food products travelling through conduit laterally beside one another are arranged in a "single file" line before each item passes through the cutter head. As shown in FIG. 1, the cutter head is in a specific section that is removable for service, change of cutting pattern and/or replacement.

In conventional hydrocutting art there are two or three conically-shaped accelerating sections that have specified angles and transitions that are used in an attempt to optimize the acceleration of the potatoes into and out of the cutting head. Similarly, the art describes specific diverging angles that attempt to controllably slow the water flow in the accelerating section of the system that can be referred to as the "exit section" (or "decelerating section"). In every case known to the inventors, the prior art devices accomplish the goal of accelerating (entry or exit sections) using linear changes of cross section over the length of the accelerating section. Sometimes two or three sections are combined in which each section has a specific angle associated with it that results in a changing acceleration through that section.

The need exists for an accelerator tube that has a superior effect on the food products as they are being accelerated just before and/or just after being cut by the blades.

BRIEF SUMMARY OF THE INVENTION

An improvement to hydrocutting systems is described herein, and includes a curved shape for the acceleration (which includes the accelerating and decelerating) sections of the system. The same method and apparatus that is used in the accelerating section that increases the velocity of the water and food products can be utilized for the deceleration section of the system.

The curvature along the accelerating section is preferably a gradual curve determined by any means, but at least by calculating the average acceleration of existing, conical or otherwise linear accelerating sections, and calculating the curvature that would result in that same (or some other) acceleration over the entire accelerating section. This curved shape is preferably derived by taking into consideration the area of the accelerating tube's cross section versus the acceleration of a water column through it, rather than the diameter of the tube's cross section versus acceleration. This derivation results in a section of the accelerating tube that causes substantially constant acceleration of the food products and water flowing through the section, which has improved effects on alignment, rotational stabilization, singulation and other characteristics of the system. Of course, other ways of calculating curvatures that would cause constant acceleration are contemplated, and will become apparent to the person of ordinary skill from the explanation herein.

In one embodiment an accelerating section has a cross section that changes as a non-linear function of the longitudinal position in the accelerating section. Thus, the area changes along the length of the accelerating section, and this change in area is due to the curvature of the sidewall of the tube. This curvature maintains the acceleration of the water and food products as a substantial constant over the length of the accelerating section. Of course, there are entry and exit variations in acceleration due to the fact that there must be a transition into and out of the constant acceleration section. However, substantially constant acceleration of the water and food products over most of the length of the accelerating section provides a more controlled acceleration of the water/product combination, thereby resulting in a more consistent orientation and speed through the cutter.

The invention preferably has the same entry velocity (upon entering the accelerating tube) as conventional hydrocutting structures but result in minimized forces on the food product, and substantially the same velocity at the cutter head as conventional hydrocutting structures with minimal eddy currents and flow separation. It is desirable to optimize the water flow to maintain a flow path that does not include eddy currents throughout the system. The invention also enables higher density of product throughput and improved orienting of the product.

The invention contemplates an accelerating tube for a hydrocutting system that includes liquid, a liquid pump, conduit through which the liquid is pumped and a blade interposed across a liquid flow path at an end of the accelerating tube for receiving at least one food product that is disposed in the liquid. The accelerating tube comprises a liquid-guiding sidewall having a longitudinally-curved surface that curves in a non-linear manner, and against which the liquid flows. The sidewall extends from an entry end to an exit end, and the sidewall is reduced in diameter to accelerate liquid flowing therethrough at a substantially constant rate. In one embodiment the cross-section of the accelerating tube is substantially circular, but any shape cross section is contemplated. Furthermore, the accelerating tube diameter can decrease from the entry end to the exit end, as is the case where the accelerating tube is used prior to entry of the liquid into the blade, or the accelerating tube diameter can decrease from the exit end to the entry end, as is the case where the accelerating tube is used after entry of the liquid into the blade (deceleration).

Since some product is wider than it is tall, it is sometimes desirable for the exit cross-section to be different from the shape of the entry end. For example, for a circular entry end, the exit end may be elliptical, or otherwise non-circularly, shaped in order to rotate the food product around the longitudinal axis. Calculating the curvature of the tube along the X-Y plane and similarly calculating the curvature of the tube in the X-Z plane generates a profile that has a constant acceleration to orient the food product along its length, and then to hydraulically balance the food product by causing it to orient along a second axis.

Figure 1:
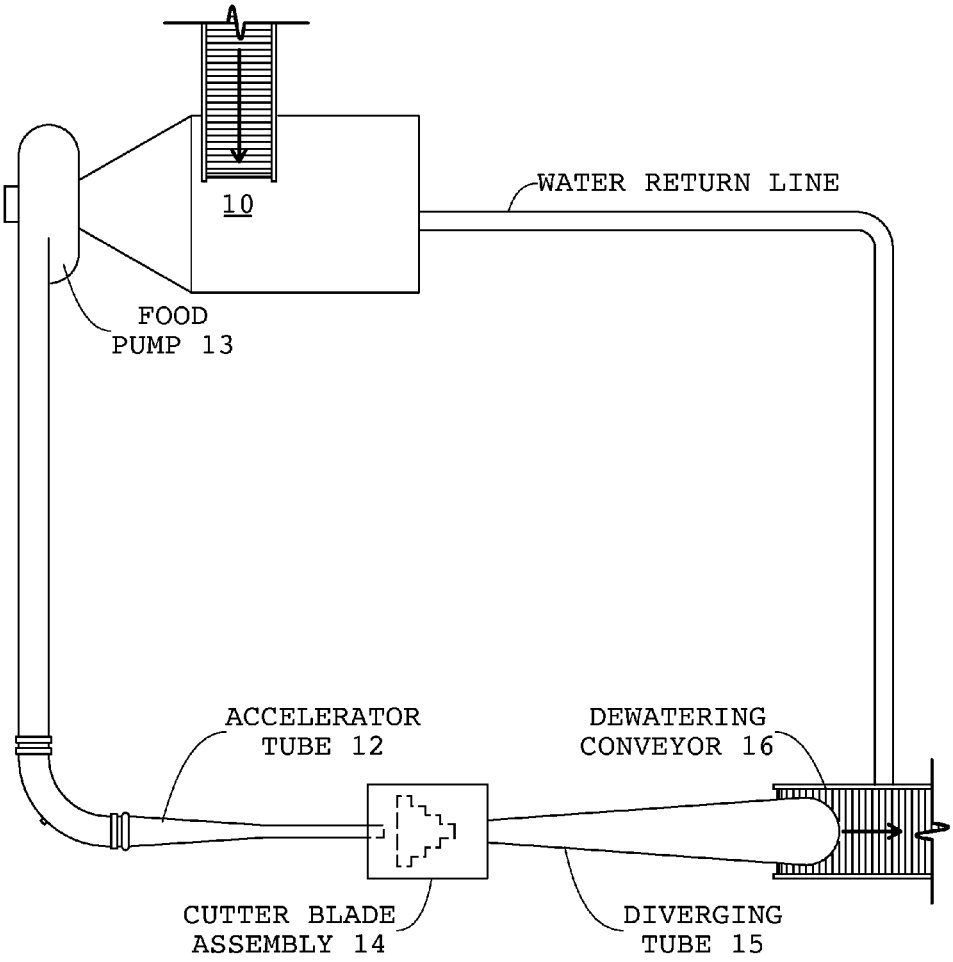
FIG. 1 (PRIOR ART)
FIG. 1 is a schematic illustration representing the conventional (prior art) hydrocutting system in which the present invention may be used.
Figure 2:
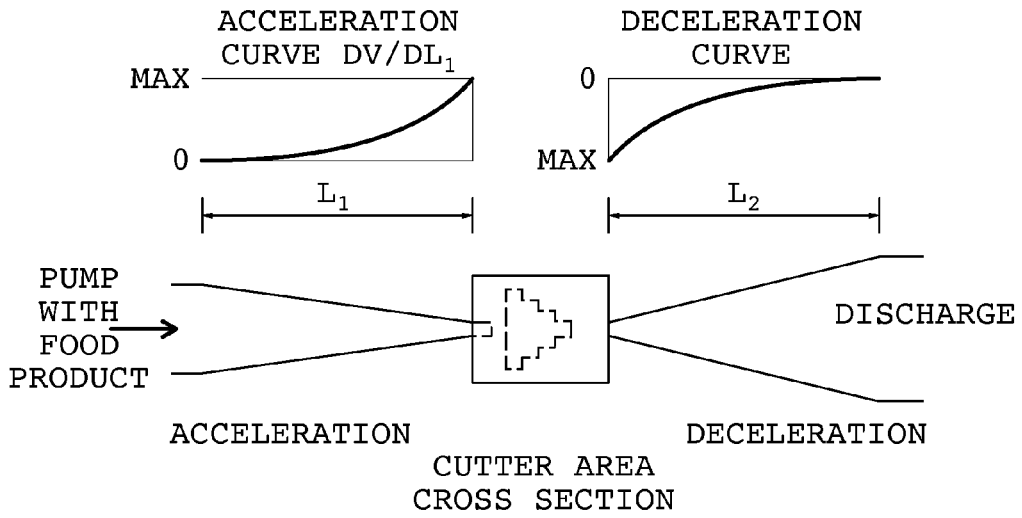
FIG. 2 (PRIOR ART)
FIG. 2 is a schematic view in section illustrating the accelerating tube, cutter head and decelerating tube of the prior art, along with graphical representations of the acceleration along the length thereof.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

U.S. Provisional Application No. 61/789,355 filed Mar. 15, 2013 and U.S. Provisional Application No. 61/878,111 filed Sep. 16, 2013 are incorporated in this application by reference.

The diameter of a tube has a circular cross section and, in a preferred embodiment, can be described as a square root function of its length to achieve the goal of substantially constant acceleration in a perfect fluid system. It is not necessary that the cross section be circular, although circular is preferred, inasmuch as constant acceleration curves can be formed in cross sectional tubes that are rectangular, triangular, polygonal or irregular. It is only necessary that the area of the cross section change over the length of the accelerating tube to cause the acceleration of the water column to be approximately constant over the length of the section, as described herein. Circular is preferred, at least in part, because circular cross sectional tubes are more feasible from a manufacturing standpoint than most or all other cross sectional shapes, and more universal in their acceptance of typical, irregular food product shapes.

Figure 3:
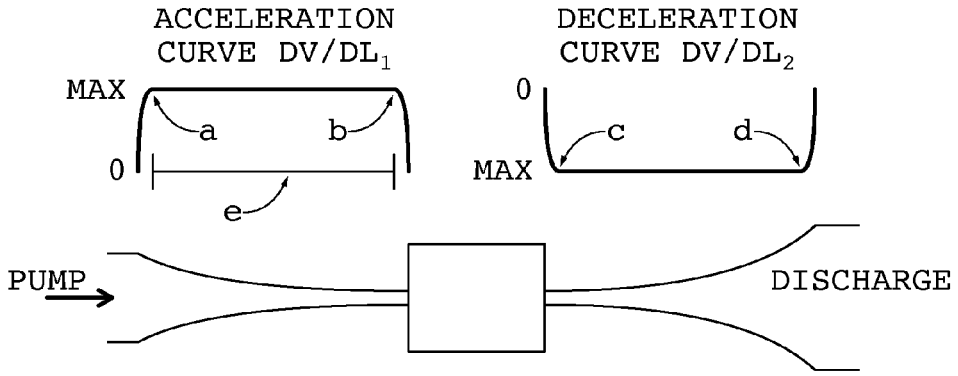
FIG. 3 is a schematic view in section illustrating the accelerating tube, cutter head and decelerating tube according to the present invention, along with graphical representations of the acceleration along the length thereof.

Although the acceleration is substantially constant, there are short "ramp up" and "ramp down" regions of non-constant acceleration due to the mass of water and food products, and these are represented in FIG. 3 by the curved ends a, b, c and d. Once achieved, substantially constant acceleration (see the section e in FIG. 3) gives an advantage on the positive acceleration side, which is upstream of the blade. Because acceleration is substantial at an earlier point along the length of the accelerating tube leading to the cutter head, and remains substantially consistent over the accelerating tube's length, the forces caused by acceleration act on the water and food products over a longer period, and those forces are substantially consistent because the acceleration is substantially constant. This consistent application of forces is particularly important when tending to rotate a relatively massive object in the flow stream, such as a food product. Rather than increasing these forces just as the food products are nearing the cutter head, as in the prior art, the invention applies the forces consistently throughout the entire length of the accelerating section to provide more time for orientation and rotational stabilization.

As a food product enters the flow stream there is a natural disturbance in the fluid system. With organically (i.e., irregularly) shaped products the specific disturbance cannot be predicted with great precision over a large number of individual pieces. Part of the disturbance is caused by the natural lag in acceleration of the product within the flow stream as the change in cross section occurs. This gives rise to a second embodiment that allows for a substantially constant acceleration (described above) but modifies the formula due to the effect of a substantially annular section of water flowing between the outer tube wall and an "inner wall" formed by the exterior of the food product. As a result of the decreasing cross section outer wall (described above) and the fixed shape "inner wall" formed by the exterior of the food product, the cross section of the annulus changes at a significantly faster rate than the entire cross section of the outer wall. This provides the incentive to reduce the maximum acceleration change demanded by the cross section change alone to, at least partially, allow for the presence of a slightly slower moving food product in the stream. Thus, the calculation of the curvature of an outer wall that will cause substantially constant acceleration may take into consideration this annular cross section and its effects.

The forces the water applies against food products as water flows through the accelerating tube (i.e., "annular forces") are desirable to orient the product along its long axis, by aligning the product's longitudinal axis substantially with the longitudinal axis of the acceleration tube, and to accelerate the product to keep it at nearly the velocity of the flow stream. When the distance over which an accelerating tube, which is constructed to create substantially constant acceleration on food products, increases, the products acted on in that section tend to singulate earlier and more gently, thereby allowing a denser stream of product to pass through the knife array. This denser stream manifests itself as a higher mass flow of product over time, which improves the efficiency of the hydrocutting system. On the deceleration side where the food product is cut into small cross section strips, the annular section consideration has far less impact because the product is more readily able to separate and follow the flow stream.

The deceleration, or negative acceleration, use of the substantially constant acceleration curved sidewall results in a smoother fluid flow in a shorter distance than the conventional linear change of cross section. It will also insure that the product is discharged from the system in a more uniform manner due to a constant flow without or with minimal reverse or eddy currents in the flow stream. With the invention the slowing of the product momentum continues nearly to the discharge point, which greatly reduces "dead zones" in the deceleration flow stream that are generated by abrupt changes in cross section or by overly aggressive or space-consuming long sections of very gradual linear tapers. The momentum maintained up to nearly the discharge point ensures that the cut strips will not be retained within slow-moving fluid sections of the deceleration section but will promptly discharge essentially in the order in which they were cut.

In the following description, the average acceleration of a conventional, linearly increasing accelerating section was calculated to determine the curvature of an accelerating section that would provide substantially constant acceleration over the same length. The average acceleration was used as a target for an accelerating section made according to the invention, because the average acceleration results from using substantially the same entry and exit velocities over the same length. However, a different acceleration quantity could be a target under different circumstances or considering different goals, and a person of ordinary skill will understand from the description herein how to adapt the calculation to achieve the desired, substantially constant acceleration. If the target acceleration differs from average acceleration of the prior technology, the resulting curvature will differ from that described herein.

Figure 7:
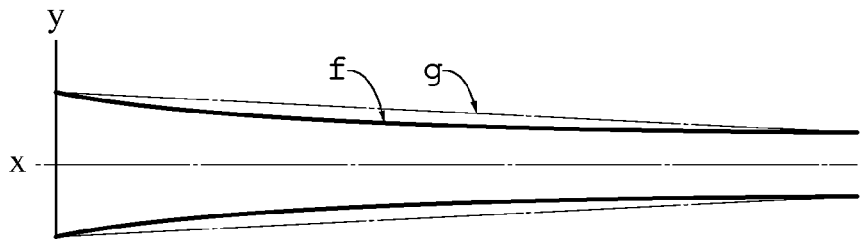
FIG. 7 is a schematic side view in section illustrating the sidewall of a conventional accelerating tube (varying acceleration) and the sidewall of an accelerating tube made according to the present invention (substantially constant acceleration).

The desired curvature of an accelerating tube was determined as a function of the position (x) along the accelerating section, and a schematic sketch of the resulting sidewalls, f, for an accelerating tube with substantially constant acceleration is shown in the illustration of FIG. 7, alongside the curvature of the conventional increasing acceleration sidewalls, g, in dashed lines. The conventional sidewalls, g, are substantially conical.

The desired curvature of an accelerating section made according to the invention was calculated as follows. Because there is a standard length and diameter in the industry, and it is desired to comply with that standard for purposes of adoption in the industry, an accelerator tube of 66 inches long with an inlet diameter of four inches and an outlet diameter of two inches was assumed. The flow rate of water in the system was assumed to be typical at about 1000 gallons per minute (GPM) or 4342 cubic inches per second. The exit speed of the accelerator tube made according to the invention should be substantially the same as the exit speed of an existing accelerator tube. Of course, that fact that a variety of starting assumptions can be utilized will be apparent from this description.

Figure 4:
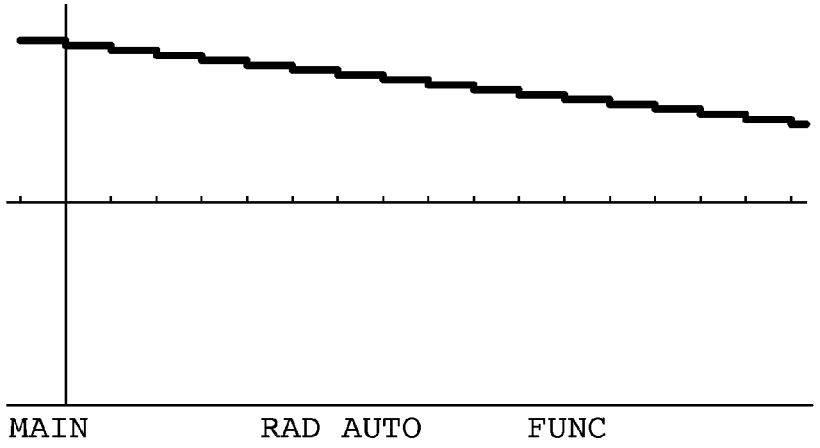
FIG. 4 is a graph of radius plotted against location along the length of a conventional acceleration tube.

To determine the shape curve of the existing accelerator tube using a slope intercept method (see FIG. 4), we use the equation $$r_{(x)} = 4 - \frac{2}{66}x,$$

where 4 is the diameter of the inlet end of the tube and 66 is the length of the tube, both in inches.

Writing velocity in terms of area yields the equation $$V_{(x)} = \frac{Q}{A}$$

It is known that $A=\pi r^2$ and $$V_{(x)} = \frac{Q}{\pi\left(4 - \frac{2}{66}x\right)^2} + 8,$$

where A is the cross sectional area of the tube.

Substituting for Q and taking the derivative of velocity with respect to x yields:

$$a_x = \frac{dVx}{dx} = -\frac{2178 * 4324}{\pi(x-132)^3}$$

The total area under the curve (see FIG. 5) represents the exit velocity of the current accelerator at 1000 GPM. The exit speed target is substantially 259 inches per second plus the initial speed of 86 inches per second. Thus the average change in velocity over 66 inches would be 3.93 in/sec$^2$ (FIG. 6).

$$a_x = \frac{dVx}{dx} = 3.93$$

Integrating obtains velocity:

$$V_x = \int \frac{dV_x}{dx} = 3.93x + 86.$$

Using the above equations to relate velocity to radius, and solving for radius as a function of longitudinal position ($r_x$) to produce the shape curve of the contour, results in:

$$r_x = \sqrt{\frac{4324}{(3.93 * x + 86) * \pi}}$$

The graph of FIG. 7 shows the curvature, f, resulting from the equation above, a profile of the accelerating tube that will produce substantially constant acceleration throughout the length thereof. The dashed lines, g, represent the linear prior art accelerator tube sidewalls and the solid lines that are curved represent the curvature of a tube sidewall that is made according to the invention. The curvature need not be exactly that shown in FIG. 7, but may be this curvature. The illustration may be exaggerated for illustrative purposes.

Figure 5:
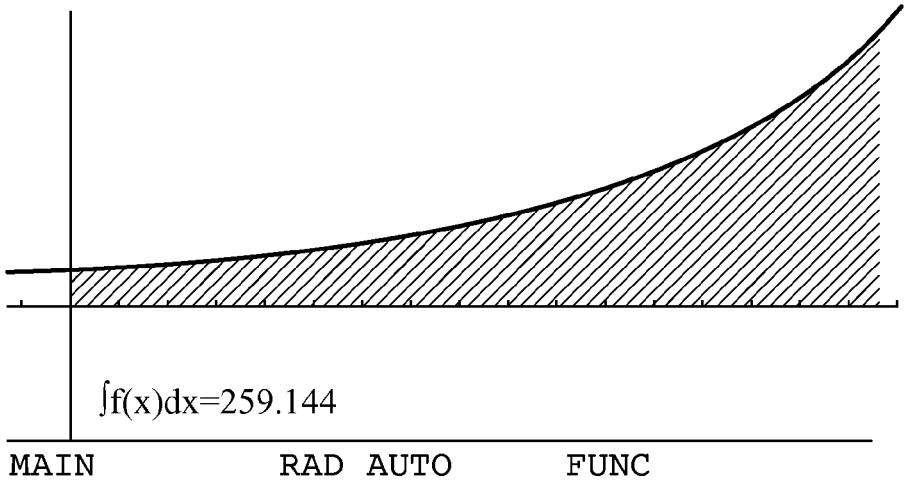
FIG. 5 is a graph of acceleration plotted against the location along the length of a conventional acceleration tube.
Figure 6:
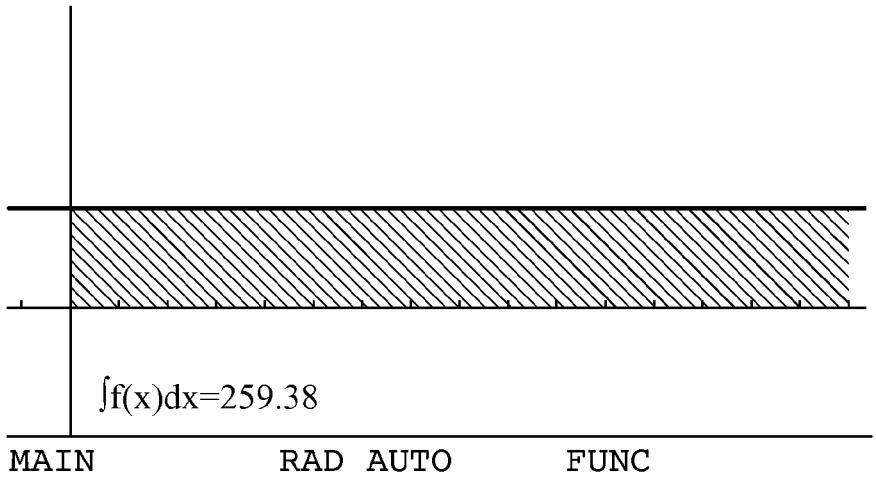
FIG. 6 is a graph of acceleration plotted against the location along the length of an acceleration tube constructed according to the present invention, in which the acceleration is substantially constant.
Figure 8:
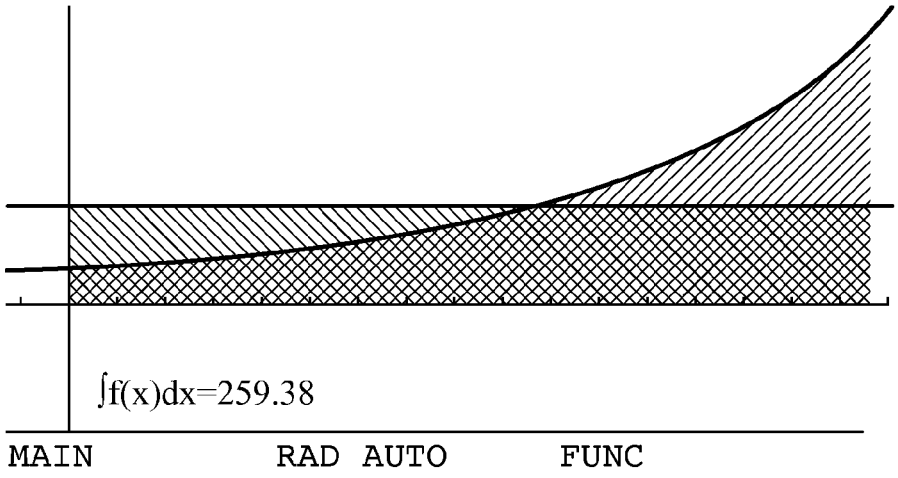
FIG. 8 is a graph of acceleration plotted against the location along the length of a conventional acceleration tube overlaid with a graph of acceleration plotted against the location along the length of an acceleration tube constructed according to the present invention for comparison purposes.

Looking at the acceleration curves of FIGS. 5 and 6, one can deduce that if the areas under the curves thereof are the same then the invention effectively re-arranged the area of the first graph (FIG. 5) to take up the room of the second graph (FIG. 6). This is illustrated in the overlay graph of FIG. 8. The geometry profile of the tube made according to the invention shows that such a tube converges earlier to decrease the rate of acceleration towards the exit end.

It should be noted that there are undoubtedly other accelerating tube sidewall shapes, and other ways of calculating substantially constant acceleration. But a few have been illustrated, discussed and calculated herein, and a person having ordinary skill will understand from the explanation herein that there are other ways of forming sidewalls of accelerating and decelerating tubes to result in substantially constant acceleration through the tubes.

An alternative embodiment of the constant acceleration tube described above is one that has, at the exit end of the tube, a non-circular opening, despite the entry end of the same tube having a substantially circular opening. In particular, although the above description for modifying the radius of the tube is applied the same to the tube along its length (thereby resulting in a circular opening at both ends in the preferred embodiment), this alternative embodiment contemplates modification of the radius of the tube differently for different axes. This results in, when considering the shape of the exit, a horizontal dimension that is different from the vertical dimension, whereas in the entry end both axes are substantially the same. The exit of an accelerating tube has a cross sectional shape other than round, for example, elliptical, despite the entry of the accelerating tube being substantially circular. The entrance to the acceleration tube would preferably remain circular in section to mate to the circular pump outlet.

The reason for this alternative embodiment is the fact that many natural food products, with potatoes or topped and tailed onions being common examples, have a somewhat flattened aspect ratio across their smaller axes. In a hydro-cutting application it is desirable to always have the longest axis (longest dimension of the food product) aligned in the direction of travel toward the cutting apparatus upon entry into the cutter head. This is the length of a carrot, to use one extreme example, and the height and width are the two shorter axes. To applicants' knowledge, prior art devices do not differentiate how the two smaller axes are oriented in space. U.S. Pat. No. 4,656,909 to Carter uses a more pronounced straight-walled tapered section in one of those axes for the purpose of gaining such an alignment. That device did not contemplate an elastomeric tube with provision for misshapen food pieces to pass through it.

A clear example of a food product that benefits from alignment of this type is the cutting of topped and tailed onions into slabs for sandwich use or further processing into onion rings. To get good finished product it is critical that the onion pass through the cutting blades aligned so that the rings come out as whole circles. Rotational orientation of the larger and smaller of the two shorter axes may be useful for the purpose of aligning those product axes with mating features that are found in the cutter. This is for the purpose of creating a more predictable cutting process for the type of product being cut.

The unique concept of this alternative embodiment is the use of more than one constant acceleration curvature along the length of the accelerating tube or section in the pursuit of a three-dimensional tubular shape that begins with what normally would be a larger circular cross section and ends with a smaller cross section that is non-circular in order to orient the length and to orient the two shorter axes. The non-circular ending shape includes, but is not limited to, an ellipse. The invention will work acceptably with nearly any desirable continuous entry and exit cross section.

The shape of the accelerating tube is generated by calculating the curvature desired to cause constant acceleration along the length of the food product as described above, and creating that curvature as described above, but only along one plane of the tube. This can be, for example, the X-Y plane (see FIG. 11), and then calculating the curvature along the other axis, for example, the X-Z plane (see FIG. 11). As calculated above, the curvature of the X-Y plane is represented by the equation $$r_x = \sqrt{\frac{4324}{(3.93 * x + 86) * \pi}} \ (X - Y \text{ plane equation}).$$

The equation representing the desired curvature through the X-Z plane could then be $$r_x = \sqrt{\frac{4324}{(10 * x + 86) * \pi}} \ (X - Z \text{ plane equation}).$$

The number "10" in the X-Z Plane Equation above has been chosen as a number different from 3.93 (which was derived above as the acceleration along for the X-Y plane curvature) because 10 is significantly different from 3.93. This significant difference thereby provides a significantly different radius across the X-Z plane of the exit, and therefore different constant acceleration in the X-Z plane. This difference in constant acceleration in the X-Z plane applies a torque to the food product travelling along the tube, thereby causing the preferential alignment of the food product with the X-Y and X-Z planes.

Therefore, by calculating and then forming curvatures that will cause constant acceleration throughout the tube's length to orient the food product's greatest dimension (length) with the tube's length and then orient the food product's other dimension (width or height), such as by rotation about the longitudinal axis, the food product can be oriented ideally as it impacts the blades.

For example, if the tube's centerline is horizontal and the cross section of entry is circular and is viewed from one end, a point at a twelve o'clock (or zero degrees) position at the entry end has a corresponding point at 12 o'clock (or zero degree) on the exit end, even if the exit end shape is not circular. For non-round shapes the points can still be understood by extending a radial line from the geometric center outward at a common angle through top dead center until the shape's perimeter is crossed.

Once the two respective points at opposing ends of the tube are established, a curve that will cause constant acceleration along the line that both connects the two points and follows the sidewall of the tube can be generated. This curve defines the shape of the tube along that particular line. Then two points at opposing ends of the tube that are offset from the first two points (such as by 90 degrees in the case of a circular entry end) may be selected and a curve can be calculated along the line connecting these two points. In a preferred embodiment, which is the example discussed above and shown in FIGS. 9-12, the first two points are at the top of the X-Y plane, and the second two points are at the side of the X-Z plane. If the entry end circle is analogized to the face of a clock, the X-Y plane is along a line connecting the 12 and 6 o'clock positions, and the X-Z plane is along a line connecting the 3 and 9 o'clock positions. The lines connecting these points at the exit end will be of different lengths, because the exit end has an elliptical shape, even though the entry end has a circular shape.

The connecting lines that are between each of the defined curve shapes can be generated (around the perimeter of the two opposing end shapes) by running similar calculations for every one degree (or plurality of degrees for less precision, or fraction of a degree for more precision) around the entire 360 degrees of the tube. The result will define a cross section that, at any point when traversing the major axis, has a smooth, calculated, constant acceleration, with constantly changing shape.

Through the use of computer-generated surfaces, the relative complexity of the calculations required to generate the shape may be overcome to describe a continuous smooth surface. The shape of the surface can further be described in terms that may be loaded into a numerically controlled machining device (e.g., CNC) to reproduce the surface in a material suitable to become a mold or template to achieve parts with the desired shape. If a hard shape is acceptable it can be generated through machining alone. If an elastomeric shape is desired it may be achieved through the use of the same machining technique for the active inside surface of a substantially tubular molded part. Other well-known analytical structural calculation methods can be utilized to describe an appropriate shape to finish the outer contours of the same part.

As food product and water flow during use through a tube of the shape described above, the hydrodynamic forces acting on the food product will tend to align the food product first along its longest axis in the direction of flow. Once that axis is substantially aligned the same hydrodynamic forces will seek the lowest possible energy state and will drive the product to substantially orient itself to the point where the product is also rotationally aligned (about the major axis) in conformance to the shape of the tube. The constant acceleration shape defined above, or a variation that allows for a food product cross-section to block a portion of the opening, provides the smoothest known transition over the longest distance available within a given length. This provides a smooth buildup of forces over the most time during the residence in the tube section for the orientation to take place and gain stability.

Figure 9:
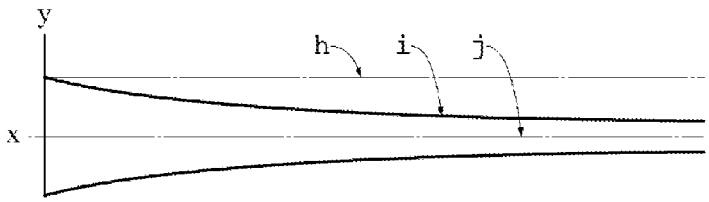
FIG. 9 is a schematic side view in section through the Y-Z plane illustrating the sidewall of an accelerating tube made according to the present invention, substantially constant acceleration along two axes, compared to a cylindrical tube.
Figure 10:
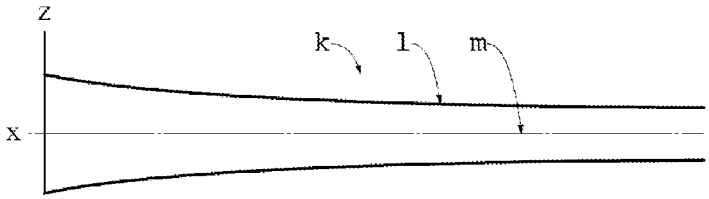
FIG. 10 is a schematic side view in section through the X-Z plane illustrating the sidewall of an accelerating tube made according to the present invention, substantially constant acceleration along two axes, compared to a cylindrical tube.
Figure 11:
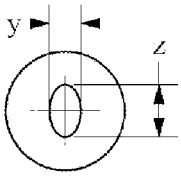
FIG. 11 is a schematic side view in section through the X-Y plane illustrating the sidewall of an accelerating tube made according to the present invention, substantially constant acceleration along two axes, compared to a cylindrical tube.

The illustrations of FIGS. 9-12 show the profile of the converging elliptical acceleration tube made according to the invention, in FIG. 9 along the X-Y (narrower) plane as viewed in FIG. 11, and in FIG. 10 along the X-Z (wider) plane. In FIGS. 9-10, the entry end is on the left and exit is on the right. The dashed lines h and k at the tops of FIG. 9-10 represent where a cylindrical tube's outer wall would exist. The dashed lines j and m near the bottoms of each drawing are the centerlines of the tubes and the solid lines i and l are the curved walls of the tube made according to the invention.

Figure 12:
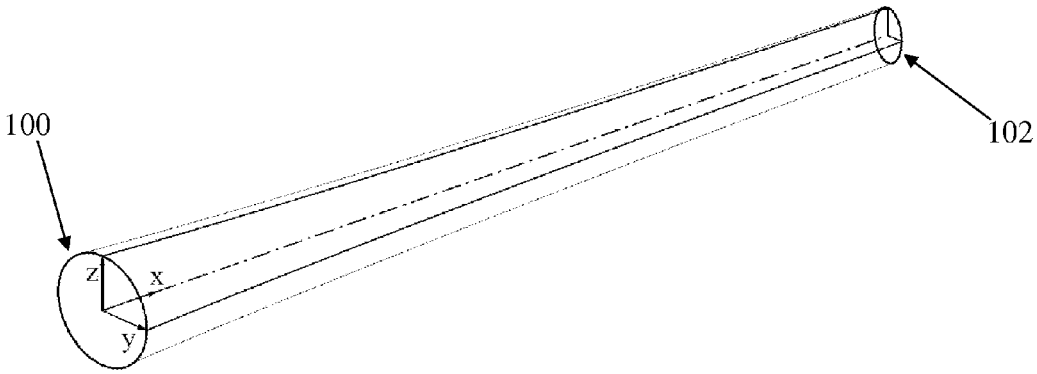
FIG. 12 is a schematic view in perspective illustrating an accelerating tube made according to the present invention, substantially constant acceleration along two axes, compared to a cylindrical tube.

The illustration of FIG. 12 shows a three-dimensional view of the tube with the left end being the entry end 100 and the right end being the exit end 102. That is, food products enter at the left end and exit at the right end in the illustration of FIG. 12.

It is understood that a curve can be simulated using a plurality of short, non-curved segments. Thus, over the length of a tube, there can be, for example, sixty-six one inch long segments, each of which is non-curved. If such an embodiment has substantially the same result in the tube of orientating food products as an actual curve that the multiple segments approximate, the two are considered equivalent and the simulation falls within the invention. The more of these non-curved sections that are used, the closer the simulation approximates an actual curve; and the fewer of the non-curved sections, the farther the simulation's results are from a curve. The present invention contemplates such simulated curves only if such simulations approximate a curve without significant and measurable differences from true curves. A ten percent difference between the simulation and the curved tube may be considered significant. A one percent difference is not.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An improved accelerating tube in a hydrocutting system that includes a liquid, a liquid pump, conduit through which the liquid is pumped and a blade interposed across a liquid flow path aligned with a longitudinal axis of the accelerating tube for receiving at least one food product that is disposed in the liquid, the accelerating tube having a liquid guiding sidewall with a reduction in diameter between an entry end and an exit end to accelerate the liquid as the liquid flows through the accelerating tube, the improvement comprising the liquid-guiding sidewall having a first longitudinally-curved surface against which the liquid flows that is reduced in diameter non-linearly, thereby causing liquid flowing therethrough to accelerate at a first substantially constant rate.

2. The improved accelerating tube in accordance with claim 1, wherein a cross-section of the accelerating tube is substantially circular.

3. The improved accelerating tube in accordance with claim 1, wherein the accelerating tube diameter decreases from the entry end to the exit end.

4. The improved accelerating tube in accordance with claim 1, wherein the accelerating tube diameter decreases from the exit end to the entry end.

5. The improved accelerating tube in accordance with claim 1, wherein a cross-section of the accelerating tube is substantially non-circular.

6. The improved accelerating tube in accordance with claim 5, wherein the liquid-guiding sidewall has a second longitudinally-curved surface against which the liquid flows that is reduced in diameter non-linearly, thereby causing liquid flowing therethrough to accelerate at a second substantially constant rate that is different from the first substantially constant rate.

7. An accelerating tube for a hydrocutting system that includes a liquid, a liquid pump, conduit through which the liquid is pumped and a blade interposed across a liquid flow path aligned with a longitudinal axis of the accelerating tube for receiving at least one food product that is disposed in the liquid, the accelerating tube comprising a liquid guiding sidewall having a first longitudinally-curved surface against which the liquid flows, said sidewall extending from an entry end to an exit end, wherein the sidewall has a reduction in diameter that is non-linear and accelerates liquid flowing therethrough at a first substantially constant rate.

8. The improved accelerating tube in accordance with claim 7, wherein a cross-section of the accelerating tube is substantially circular.

9. The accelerating tube in accordance with claim 7, wherein the accelerating tube diameter decreases from the entry end to the exit end.

10. The accelerating tube in accordance with claim 7, wherein the accelerating tube diameter decreases from the exit end to the entry end.

11. The improved accelerating tube in accordance with claim 7, wherein a cross-section of the accelerating tube is substantially non-circular.

12. The improved accelerating tube in accordance with claim 11, wherein the liquid-guiding sidewall has a second longitudinally-curved surface against which the liquid flows that is reduced in diameter non-linearly, thereby causing liquid flowing therethrough to accelerate at a second substantially constant rate that is different from the first substantially constant rate.

* * * * *